US005671483A

United States Patent [19]

Reuber

[11] Patent Number: 5,671,483

[45] Date of Patent: Sep. 30, 1997

[54] REMOVABLE SUBSIDIARY HELMET FACE SHIELD LENS

[75] Inventor: Douglas Alvin Reuber, Lindsay, Canada

[73] Assignee: Ontario Limited, Lindsay, Canada

[21] Appl. No.: 469,079

[22] Filed: Jun. 6, 1995

[51] Int. Cl.[6] ..... A42B 3/24

[52] U.S. Cl. ..... 2/424; 2/434; 2/435; 2/441

[58] Field of Search ..... 2/424, 425, 435, 2/441, 434, 10, 9, 428, 430, 443; 219/211, 203

[56] References Cited

U.S. PATENT DOCUMENTS

| | | | |
|---|---|---|---|
| 3,505,680 | 4/1970 | Ring | 2/441 |
| 4,047,249 | 9/1977 | Booth | 2/434 X |
| 4,070,712 | 1/1978 | Marwitz | 2/424 |
| 4,101,980 | 7/1978 | Stepan et al. | 2/434 X |
| 4,507,809 | 4/1985 | Stepan | 2/424 |
| 4,584,721 | 4/1986 | Yamamoto | 2/435 X |
| 5,351,339 | 10/1994 | Reuber et al. | 2/435 X |

OTHER PUBLICATIONS

Gershman, "Self-Adhering Nylon Tapes", J.A.M.A., p. 930 Oct. 1958.

*Primary Examiner*—Peter Nerbun

*Attorney, Agent, or Firm*—G. Kendall Parmelee; Parmelee & Bollinger, LLP

[57] ABSTRACT

A face shield for a helmet comprises a body with an opening, an inner lens mounted in the body opening and a weather lens releasably mountable over the inner lens. The weather lens has a gasket around its perimeter which spaces the weather lens from the inner lens to form an insulating air gap between the inner lens and the weather lens. The weather lens is made of translucent material to selectively filter the light passing through the lens. The inner lens is recessed in the body so that the weather lens is generally flush with the outer surface of the body. Each side edge of the weather lens is provided with one of a hook and loop fastener and the inner lens has the complimentary fastener portion for mounting the weather lens to the inner lens.

22 Claims, 3 Drawing Sheets

REMOVABLE SUBSIDIARY HELMET FACE SHIELD LENS

BACKGROUND OF THE INVENTION

1. Field of the Invention

The present invention relates to an improved helmet face shield and removable lens for use with a helmet face shield.

2. Description of the Related Art

Protective helmets used for snowmobiling and motorcyling may have a face shield with a transparent lens.

The lenses of typical face shields are subject to fogging or icing. One solution to this problem is to apply a defogging or de-icing substances to the face shield. Such substances must be frequently re-applied and are often not effective.

Another solution incorporates two lenses in the face shield. These two lenses are positioned adjacent to each other to form an appreciable air gap between the lenses. The combination of the two lenses and an appreciable air gap forms an insulated inner face shield. In such an arrangement, the temperature difference between the inner lens and the interior of the helmet is diminished thereby decreasing the likelihood of fog forming on the interior lens. Similarly, the increased temperature of the inner lens reduces the likelihood of ice forming on the lenses.

A further solution incorporates an electric heating element on a lens forming part of the helmet. Once again, this arrangement maintains the lens at a moderate temperature thus diminishing the likelihood of fogging. Similarly, the increased temperature of the lens reduces the likelihood of ice forming on the lens. For example, U.S. Pat. No. 3,024,341 discloses arrangements providing this solution.

Combinations of the above solutions are also known. For example Canadian Patent No. 1,285,976 U.S. Pat. No. 2,120,324 disclose face shields having double lenses and lens heating means.

Another problem encountered by the users of helmets is bright lights and sunlight. One known solution to this problem is for the user of a helmet to wear sunglasses under the face shield. This solution is, however, not always practical as such eyewear often further obstructs the user's field of vision. Moreover, sunglasses have a tendency to fog and may not fit under all known face shields.

Another solution has been to tint the lens used in such a helmet to block bright light and sunlight. This solution is unsatisfactory as the helmet may only be used in bright light and must be exchanged or modified in less bright conditions.

U.S. Pat. No. 4,584,721 discloses an electric heating device for preventing a helmet shield from fogging. This device comprises a removable lens piece attached behind the helmet lens. The lens piece has peripheral electric conductors with conductive film therebetween. Moreover, the conductive film of the heating device while transparent, is colored, thereby protecting the eyes of the wearer. This device, however, is unsuitable for quick attachment or removal as it is mounted on the interior surface of the shield. Furthermore, the sun resistant/retardant nature of the device is limited to the intrinsic light transmission characteristics of the conductive layer.

The present invention seeks to overcome disadvantages of the prior art.

SUMMARY OF THE INVENTION

According to one aspect of the invention, there is provided a face shield for a helmet comprising a body having an opening; an inner lens mounted in the opening so as to have a convex outer surface and a concave inner surface; a weather lens overlapping the outer surface and mounted adjacent to the outer surface; means to space the weather lens from the outer surface so as to form an appreciable air gap between the weather lens and the outer surface; means removably attaching the weather lens to at least one of the inner lens and the body.

According to another aspect of the invention there is provided a face shield for a helmet comprising a body having an opening; an inner lens fixedly mounted in the opening to form a recess; and a first fastener element on one of the body and the inner lens interengageable with a complementary fastener element of a weather lens of a type which is mountable in overlapping relation to the inner lens adjacent to the inner lens in the recess.

According to a further aspect of the invention, there is provided in combination, a weather lens and a face shield of a helmet, the weather lens comprising: a sheet of flexible plastic; a gasket extending from the sheet of plastic along a perimeter and on a first side of the sheet to space the weather lens from an inner lens forming part of the face shield, when the weather lens is mounted on the face shield; a first fastener portion, portion extending from the sheet on the first side, for mounting the sheet to the shield, the shield having a convex surface; a complementary fastener portion, comprising a second fastener portion affixed to the convex surface of the face shield; an opposite surface for engaging the first fastener portion to mount the weather lens to the face shield in an overlapping relationship with the inner lens, whereby the weather lens may be quickly mounted and removed from the face shield, and the complementary fastener position, when the complementary fastener portion is mounted to the shield.

BRIEF DESCRIPTION OF THE DRAWINGS

In the drawings which illustrate a preferred embodiment of the present invention.

DESCRIPTION OF THE PREFERRED EMBODIMENT

Figure 1:
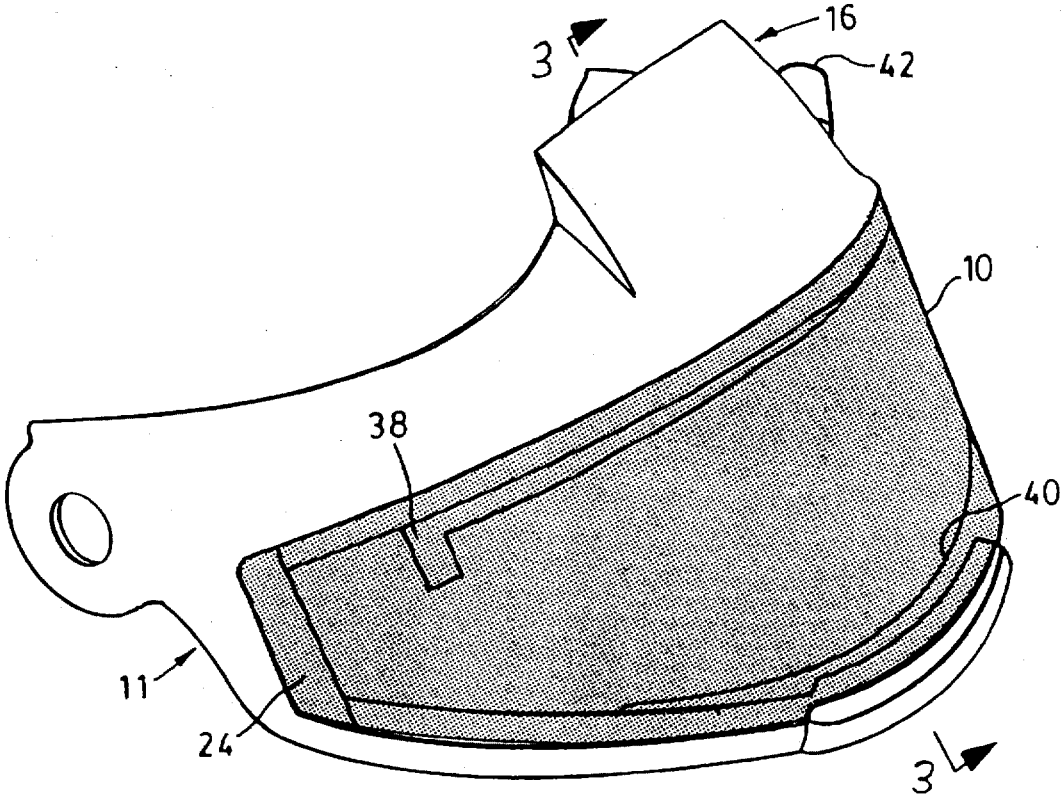
FIG. 1 is a perspective view of a face shield made in accordance with this invention.
Figure 2:
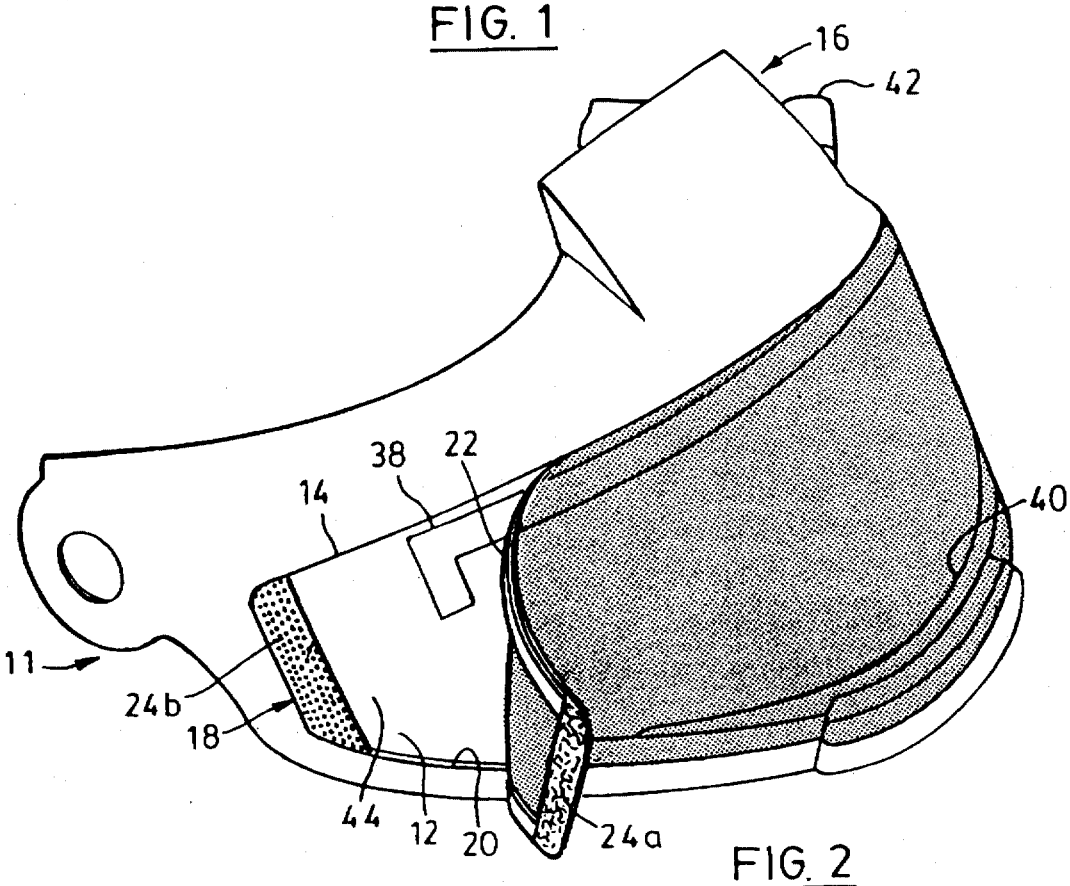
FIG. 2 is a perspective of the face shield of FIG. 1 with a weather lens partially detached.
Figure 3:
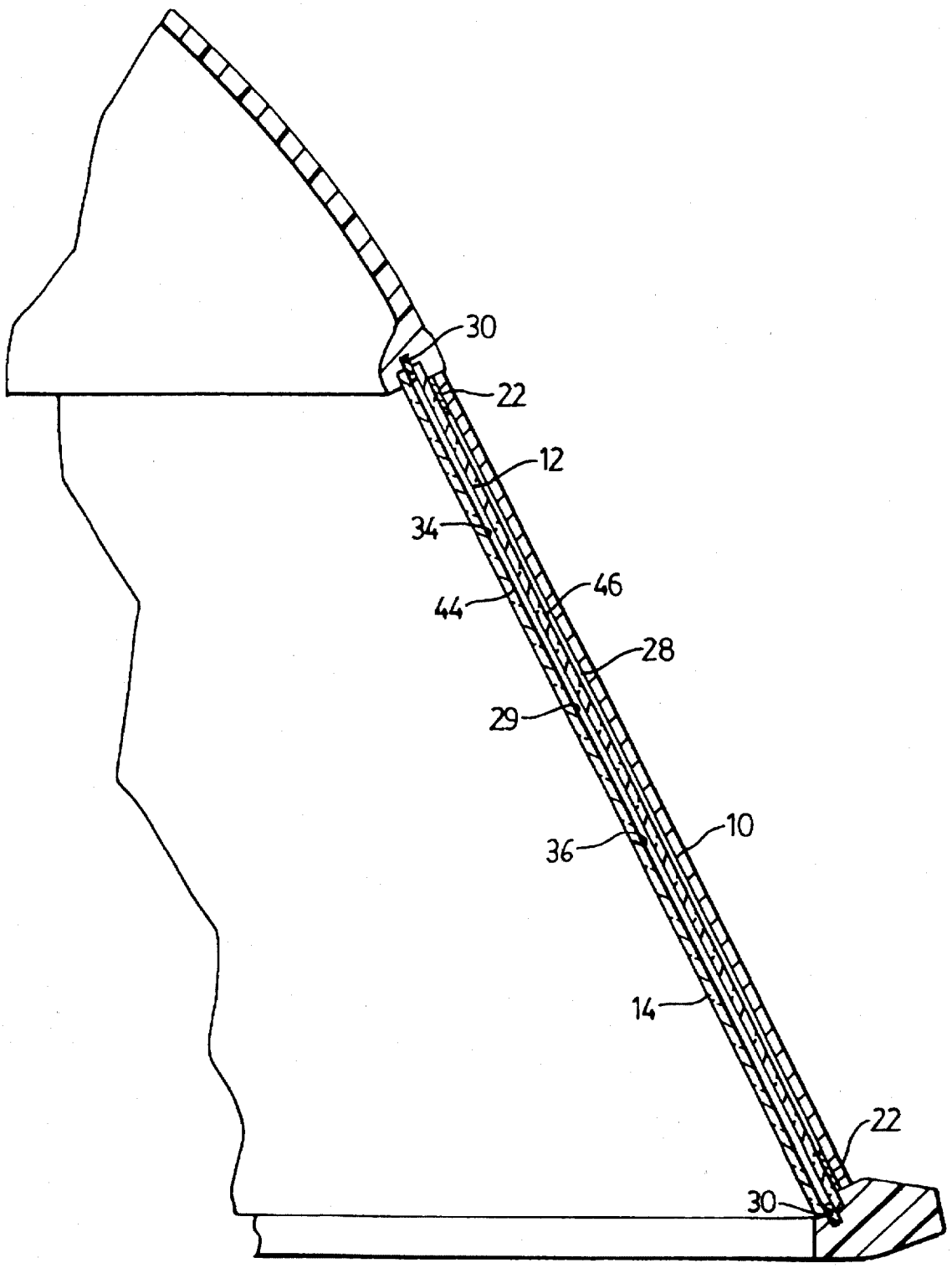
FIG. 3 shows a cross section along the lines 3—3 of FIG. 1.

Turning to FIGS. 1 to 3 a face shield 11 has a body 16 with an opening 18 receiving, in order from inside to outside, a face lens 14, an inner lens 12 and a translucent weather lens 10. The inner lens 12 and face lens 14 are permanently mounted in opening 18 of body 16 such that the inner lens 12 has a convex outer surface 44 and a concave inner surface 46. The inner lens 12 and the body 16 form a recess 20 and weather lens 10 is mounted in this recess 20 in overlapping relation with the inner lens 12.

Figure 4:
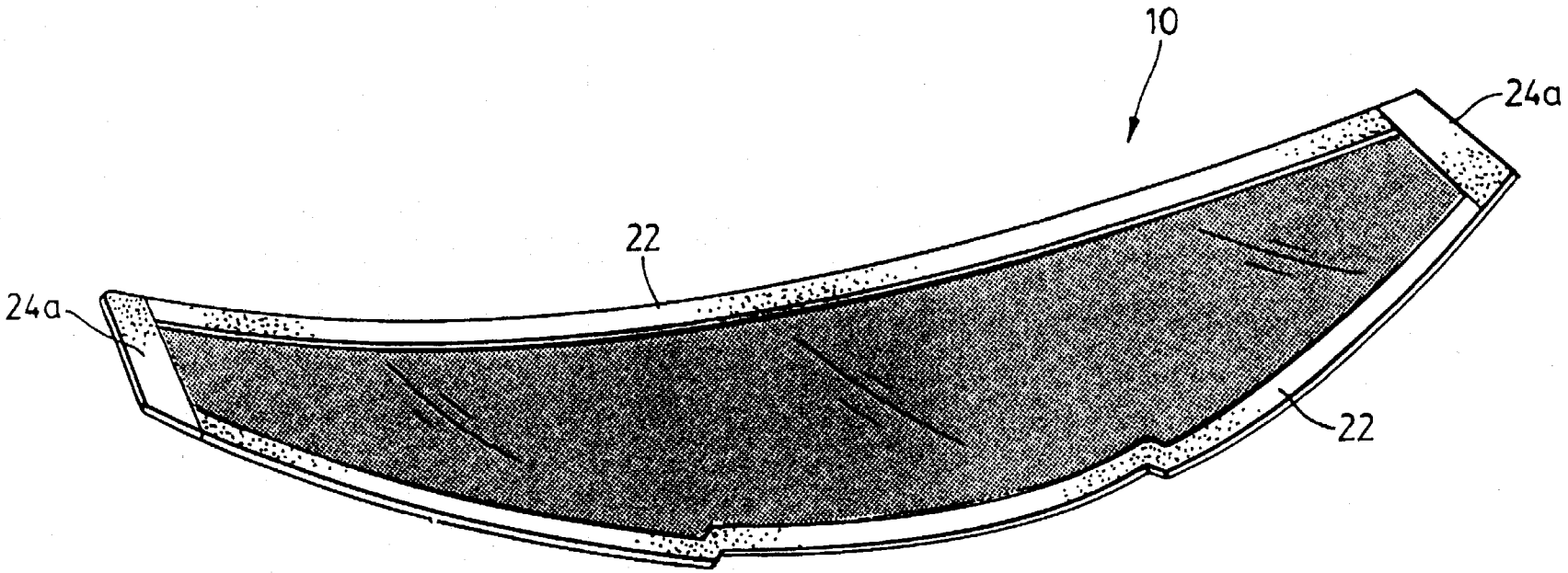
FIG. 4 is a perspective view of the weather lens.

As best seen in FIG. 4, a gasket 22 functions as a means to space the weather lens 10 from the outer surface of the inner lens 12 so as to form an appreciable air gap 28 (FIG. 3) between the weather lens 10 and the inner lens 12.

The weather lens 10 is attached to the inner lens 12 by means of a hook and loop fastener 24 at either end of the weather lens 10. The loop portion 24a (FIG. 2) of the hook and loop fastener 24 is affixed to the weather lens 10, while the hook portion 24b (FIG. 2) is affixed to the inner lens 12. The weather lens 10 can thus be removed from the face shield 11.

Inner lens 12 is spaced by means of another gasket 30 (FIG. 3) from face lens 14, thereby creating a further appreciable air gap 29 (FIG. 3) between the inner surface of the inner lens 12 and face lens 14.

The face shield 11 is further equipped with electrical means to defog the face lens 14 and the inner lens 12, as follows. The face lens 14 has an outer surface 34 which is coated with a transparent conductive film 36. Two electrodes 38 and 40 extend along a top and bottom margin, respectively, of the outer surface 34 of the face lens 12. The near end of electrodes 38 and the far end of the other electrode 40 are attached to a terminal connector 42 (FIGS. 1 and 2) for connection to a power source.

In operation, the face shield 11 is typically attached to a helmet worn by a motorcyclist or a snowmobile operator. The weather lens 10 may be mounted to the inner lens 12 of on the face shield 11 by means of hook and loop fasteners 24. When mounted, the weather lens 10 is substantially coextensive with the inner lens 12 and is in recess 20 formed by the inner lens 12 and the body 16. As aforenoted, the gasket 22 along the weather lens results in an appreciable air gap 28 between the weather lens 10 and the inner lens 12. This air gap 28 acts as an insulating layer between the outside of the weather lens 10 and the interior of the helmet.

The weather lens gasket 22 and recess 20 are sized so that the weather lens 10 is generally flush with the outer surface of the body 16 of the face shield 11. With this arrangement no portion of the weather lens 10 protrudes. Therefore, the weather lens 10 is not subject to dislodging wind forces which could otherwise potentially separate the weather lens 10 from the face shield 11.

The weather lens 10 is made of a translucent material which selectively filters the light which passes through the weather lens 10. Thus, by appropriate choice of the translucent material, the weather lens 10 acts to block harmful sunlight or other bright lights. A high definition material may also be employed to provide a high definition lens which will not only block ultra-violet light but will also provide better depth perception. It will also be appreciated that the weather lens protects the inner lens from scratching. This is an important feature since the cost of replacing the weather lens is much less than replacing the face shield to which the inner lens is permanently mounted. When the weather lens 10 is not required, it may be freely removed from the face shield 11 by an operator sliding a fingernail or similar object under an edge of the lens, proximate one of the fasteners 24 and pulling outwardly in order to peel off the lens.

When terminal connector 42 is connected to a source of electric power, such as a motorcycle or snowmobile battery, a potential difference is established between the two electrodes 38 and 40. This potential difference causes electric current to flow through the transparent conductive film 36. This electric current, in turn, heats the conductive film 36 and thereby prevents ice or fog from forming on either the inner lens 12 or face lens 14.

It will be appreciated that the preferred embodiment described comprises a face shield 11 with a removable weather lens 10. In other embodiments, by providing an existing helmet or face shield with hook positions of a hook or loop fastener, the weather lens may be retrofit to existing face shields or helmets. The weather lens need not be translucent nor made of plastic. For example, it may be entirely transparent, thereby only serving as an extra insulation layer and not serving as a means to block bright light. Alternatively, the weather lens may be adapted to selectively filter light to brighten the user's view. Similarly, the weather lens need not sit flush with the body 16 of the face shield, but may be further recessed. The fastener attaching the weather lens 10 to the face shield need not be hook and loop fasteners 24, but may be any other fastener system including a button and dome system, a zipper system or the like.

It is further understood that the invention is not limited to the illustrations described and shown herein, which are deemed to be merely illustrative of the best modes of carrying out the invention, and which are susceptible to modification of form, size, arrangement of parts and details of operation. The invention, rather, is intended to encompass all such modifications which are within its spirit and scope as defined by the claims.

What is claimed is:

1. A face shield for a helmet comprising:

a body having an opening;

an inner lens mounted in said opening so as to have a convex outer surface and a concave inner surface;

a weather lens overlapping said outer surface and mounted adjacent to said outer surface;

means to space said weather lens from said outer surface so as to form an appreciable air gap between said weather lens and said outer surface;

means removably attaching said weather lens to at least one of said inner lens and said body.

2. The face shield of claim 1 wherein said inner lens and said body form a recess; and said weather lens is mounted in said recess.

3. The face shield of claim 2 wherein said inner lens is formed of transparent plastic; and said weather lens is formed of translucent plastic.

4. The face shield of claim 3 wherein said translucent plastic is adapted to selectively filter light that passes through said weather lens.

5. The face shield of claim 4 wherein said means to space said weather lens from said outer surface comprises a gasket extending along a perimeter of one of said inner lens and said weather lens.

6. The face shield of claim 5 wherein said means removably attaching said weather lens to at least one of said inner lens and said body comprises a first fastener element on one of said body and said inner lens; and a second complementary fastener element on said weather lens.

7. The face shield of claim 6 wherein said first fastener element comprises one of a hook portion and a loop portion of a hook and loop fastener;

said second fastener element comprises a complementary one of a hook portion and a loop portion of a hook and loop fastener.

8. The face shield of claim 7 wherein said inner lens and said weather lens are coextensive.

9. The face shield of claim 8 further comprising a face lens mounted in said body adjacent to said inner surface of said inner lens;

means to space said face lens from said inner lens so as to form an appreciable air gap between said inner surface and said face lens.

10. The face shield of claim 9 wherein said means to space said inner surface from said face lens comprises a gasket extending along a perimeter of one of said inner lens and said face lens.

11. The face shield of claim 10 further comprising means to defog at least one of said inner lens and said face lens.

12. The face shield of claim 11 wherein said face lens has an outer surface facing said air gap; and said means to defog comprises a first electrode extending along a margin of said face lens on said face lens outer surface;

a second electrode extending along a margin of said face lens opposite said first electrode on said face lens outer surface;

said first electrode and said second electrode are electrically connected to a terminal connector for connecting to a source of electric power;

a transparent conductive film extending between said first electrode and said second electrode on said face lens outer surface, said film having sufficient electrical resistance to create heat effective to inhibit formation of fog, ice or frost on at least one of said inner lens and said face lens when said terminal connector is connected to a source of electric power.

13. A face shield for a helmet comprising:

a body having an opening;

an inner lens fixedly mounted in said opening to form a recess; and a first fastener element on one of said body and said inner lens interengageable with a complementary fastener element of a weather lens of a type which is mountable in overlapping relation to said inner lens adjacent to said inner lens in said recess.

14. A face shield as claimed in claim 13 further comprising a weather lens comprising a sheet of flexible plastics; and a second complementary fastener element affixed to said flexible plastic, adapted for mounting said flexible plastic on one of said body and said inner lens; and means to space said weather lens from said inner lens so as to form an appreciable air gap between said weather lens and said inner lens.

15. The face shield of claim 14 wherein said inner lens is formed of transparent plastic; and said weather lens is formed of a translucent plastic.

16. The face shield of claim 15 wherein said translucent plastic is adapted to selectively filters light that passes through said weather lens.

17. The face shield of claim 16 wherein said means to space said weather lens from said inner lens comprises a gasket extending along a perimeter of one of said inner lens and said weather lens.

18. The face shield of claim 17 wherein said first fastener element comprises one of a hook portion and a loop portion of a hook and loop fastener;

said second fastener element comprises a complementary one of a hook portion and a loop portion of a hook and loop fastener.

19. The face shield of claim 18 wherein said weather lens and said inner lens are coextensive.

20. In combination, a weather lens and a face shield of a helmet, said weather lens comprising:

a sheet of flexible plastic;

a gasket extending from said sheet of plastic along a perimeter and on a first side of said sheet to space said weather lens from an inner lens forming part of said face shield, when said weather lens is mounted on said face shield;

a first fastener portion, extending from said sheet on said first side, for mounting said sheet to said shield;

said shield having a convex surface and a complementary fastener portion, comprising:

a second fastener portion affixed to said convex surface of said face shield;

an opposite surface for engaging said first fastener portion to mount said weather lens to said face shield in an overlapping relationship with said inner lens;

whereby said weather lens may be quickly mounted and removed from said face shield, and said complementary fastener position.

21. The combination of claim 20 wherein said sheet of flexible plastic is translucent.

22. A face shield as claimed in claim 13, wherein said inner lens and said body define a convex outer surface; and wherein said first fastener element extends from said convex outer surface and comprises engagement means extending outwardly from said outer surface.

* * * * *